US009333407B2

(12) United States Patent
Lin

(10) Patent No.: US 9,333,407 B2
(45) Date of Patent: May 10, 2016

(54) COUNTERWEIGHT DEVICE FOR HITTING TRAINER

(71) Applicant: Hung-Tai Lin, Taichung (TW)

(72) Inventor: Hung-Tai Lin, Taichung (TW)

( * ) Notice: Subject to any disclaimer, the term of this patent is extended or adjusted under 35 U.S.C. 154(b) by 230 days.

(21) Appl. No.: 14/029,969

(22) Filed: Sep. 18, 2013

(65) Prior Publication Data

US 2015/0080194 A1 Mar. 19, 2015

(51) Int. Cl.
*A63B 21/00* (2006.01)
*A63B 69/20* (2006.01)
*A63B 71/02* (2006.01)

(52) U.S. Cl.
CPC ..... *A63B 69/208* (2013.01); *A63B 2071/026* (2013.01); *A63B 2210/50* (2013.01)

(58) Field of Classification Search
CPC ..... A63B 21/00
USPC ..... 482/104–108; 128/157
See application file for complete search history.

(56) References Cited

U.S. PATENT DOCUMENTS 4,854,576 A * 8/1989 McWain ..... 482/106
5,300,001 A * 4/1994 Sealy ..... 482/108
8,425,385 B2 * 4/2013 Bonutti ..... 482/112

* cited by examiner

*Primary Examiner* — Jerome w Donnelly
(74) *Attorney, Agent, or Firm* — Ming Chow; Sinorica, LLC

(57) ABSTRACT

A counterweight device is mounted to a hitting trainer. The hitting trainer includes a base, an upright rod disposed on the base, and a hitting member connected to the upright rod. The counterweight device includes a counterweight bag which can be extended or compressed. When in use, the counterweight bag is fitted on the base and then the counterweight bag is pulled to unfold. Finally, external liquid is poured into the counterweight bag to increase the weight of the counterweight bag, such that the hitting trainer can be placed on the uneven ground stably. When the counterweight device is not used, the counterweight bag is detached from the hitting trainer and compressed to reduce the volume of the counterweight bag for storage and carrying.

9 Claims, 6 Drawing Sheets

COUNTERWEIGHT DEVICE FOR HITTING TRAINER

BACKGROUND OF THE INVENTION

1. Field of the Invention

The present invention relates to a counterweight device, and more particularly to a counterweight device for a hitting trainer used for the art of attack and defense, kicking, boxing and so on.

2. Description of the Prior Art

For the user to practice the art of attack and defense, kicking, boxing and so on, a hitting practice device is developed. The hitting practice device comprises a hollow base, a rod extending upward from the top of the base, and an elastic sleeve fitted on the rod. The top of the rod has an opening. The opening is provided with a cover. External water can be poured into the hollow base to firm the hollow base, such that the hollow base will not topple over when the user practices hitting.

However, for a stable effect, the hollow base of the foresaid hitting practice device must have a larger volume. It is inconvenient for movement and storage. Therefore, the applicant of the present application developed a hitting trainer. A sucking disc unit is provided in the base. The sucking disc unit is connected with an air-extracting unit. The air-extracting unit is connected with a hitting unit. When the user hits the hitting unit, the air-extracting unit can extract the air in the sucking disc unit for the sucking disc unit to be attached to the ground stably. Thus, the hitting trainer is stable effectively when in use, and it is convenient for movement and storage because the sucking disc unit is small.

Although the aforesaid hitting trainer has stability and can be stored conveniently, the sucking disc unit cannot be effectively attached to the uneven ground. Accordingly, the inventor of the present invention has devoted himself based on his many years of practical experiences to solve these problems.

SUMMARY OF THE INVENTION

The primary object of the present invention is to provide a counterweight device for a hitting trainer. The hitting trainer can be placed on the uneven ground stably. The counterweight device can be stored conveniently.

In order to achieve the aforesaid object, the counterweight device of the present invention is mounted to a hitting trainer. The hitting trainer comprises a base, an upright rod disposed on the base, and a hitting member connected to the upright rod for hitting practice. The counterweight device comprises a counterweight bag. The counterweight bag is an annular bag. The counterweight bag has a pair of side walls, an inner annular wall, and an outer annular wall. The inner annular wall and the outer annular wall are connected between the pair of side walls. The inner annular wall and the outer annular wall each have a plurality of spaced telescopic portions for the counterweight bag to be extended or compressed. The inner annular wall is configured in a circle to form a through hole in the counterweight bag. An accommodation room is defined among the pair of side walls, the inner annular wall and the outer annular wall. The accommodation room communicates with at least one opening.

When the counterweight device of the present invention is used, the upright rod is inserted through the through hole so that the counterweight bag is fitted on the base. The counterweight bag is unfolded by extending the telescopic portions to increase the volume of the accommodation room. Finally, external liquid is poured into the accommodation room through the water inlet to increase the weight of the counterweight bag, such that the hitting trainer can be placed on the uneven ground stably. When the counterweight device is not used, the counterweight bag is detached from the hitting trainer. The counterweight bag is folded by compressing the telescopic portions to reduce the volume of the counterweight bag for storage and carrying.

DETAILED DESCRIPTION OF THE PREFERRED EMBODIMENTS

Embodiments of the present invention will now be described, by way of example only, with reference to the accompanying drawings.

Figure 1:
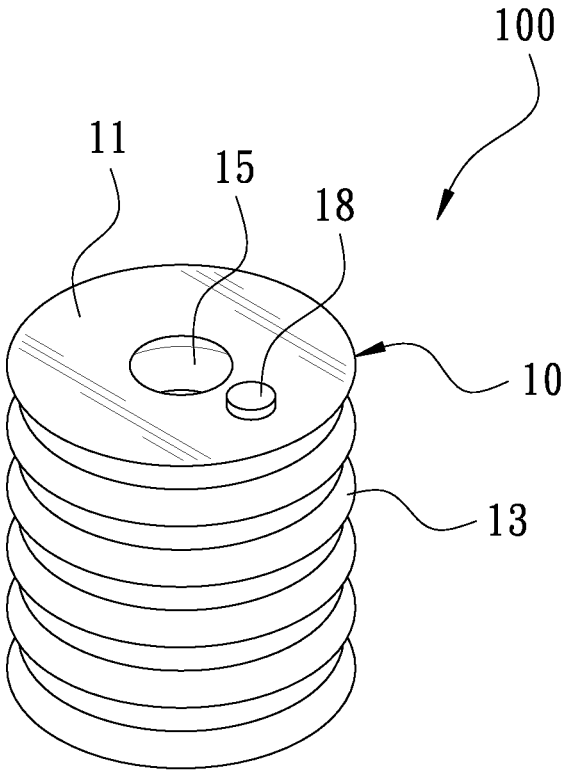
FIG. 1 is a perspective view according to a first embodiment of the present invention.
Figure 2:
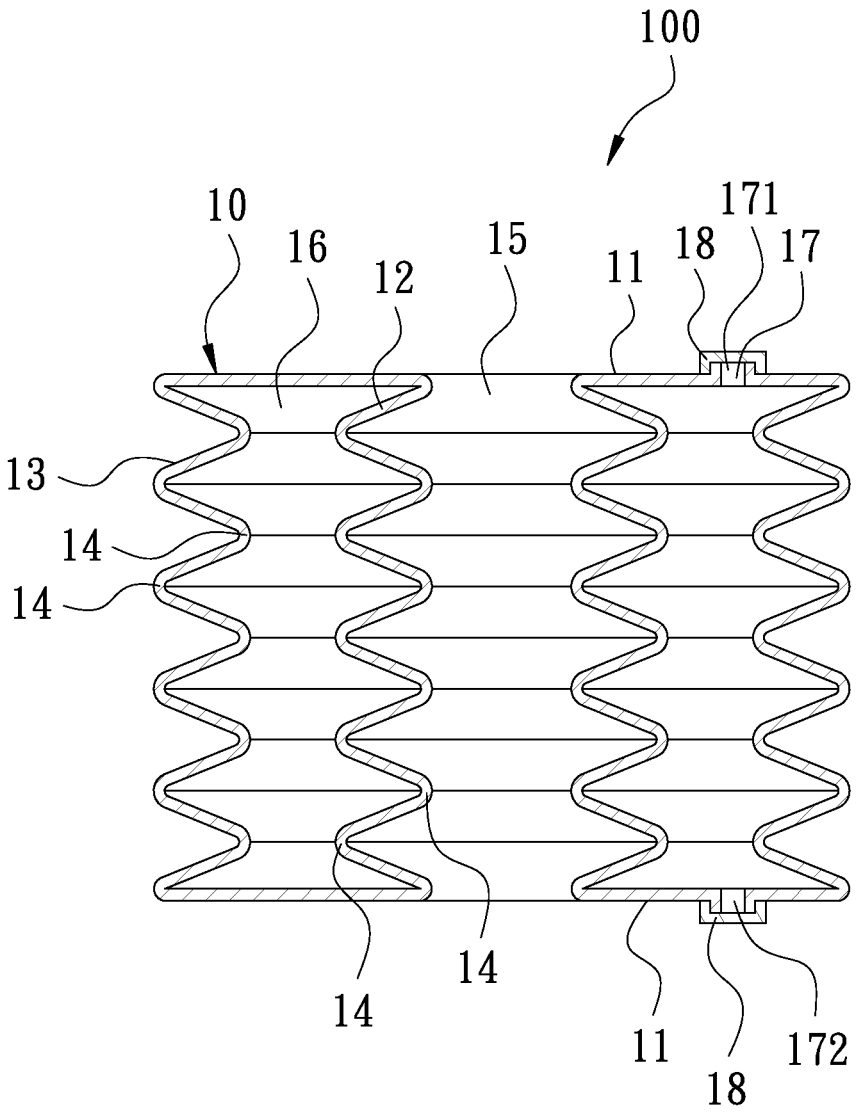
FIG. 2 is a sectional view according to the first embodiment of the present invention.

FIG. 1 is a perspective view according to a first embodiment of the present invention. FIG. 2 is a sectional view according to the first embodiment of the present invention. The present invention discloses a counterweight device 100 for a hitting trainer. The counterweight device 100 comprises a counterweight bag 10.

The counterweight bag 10 is an annular bag. The counterweight bag 10 has a pair of side walls 11, an inner annular wall 12, and an outer annular wall 13. The inner annular wall 12 and the outer annular wall 13 are connected between the pair of side walls 11. The inner annular wall 12 and the outer annular wall 13 each have a plurality of spaced telescopic portions 14, so that the counterweight bag 10 can be extended or compressed. In this embodiment, the inner annular wall 12 and the outer annular wall 13 are bent symmetrically to form a wavy shape. The telescopic portions 14 are disposed at each wave crest and each wave trough. The inner annular wall 12 is configured in a circle to form a through hole 15 in the counterweight bag 10. An accommodation room 16 is defined among the pair of side walls 11, the inner annular wall 12 and the outer annular wall 13. The accommodation room 16 communicates with at least one opening 17. In this embodiment, the counterweight bag 10 has two openings 17. The two openings 17 respectively define a water inlet 171 and a water outlet 172. Each opening 17 is provided with a cover 18.

Figure 3:
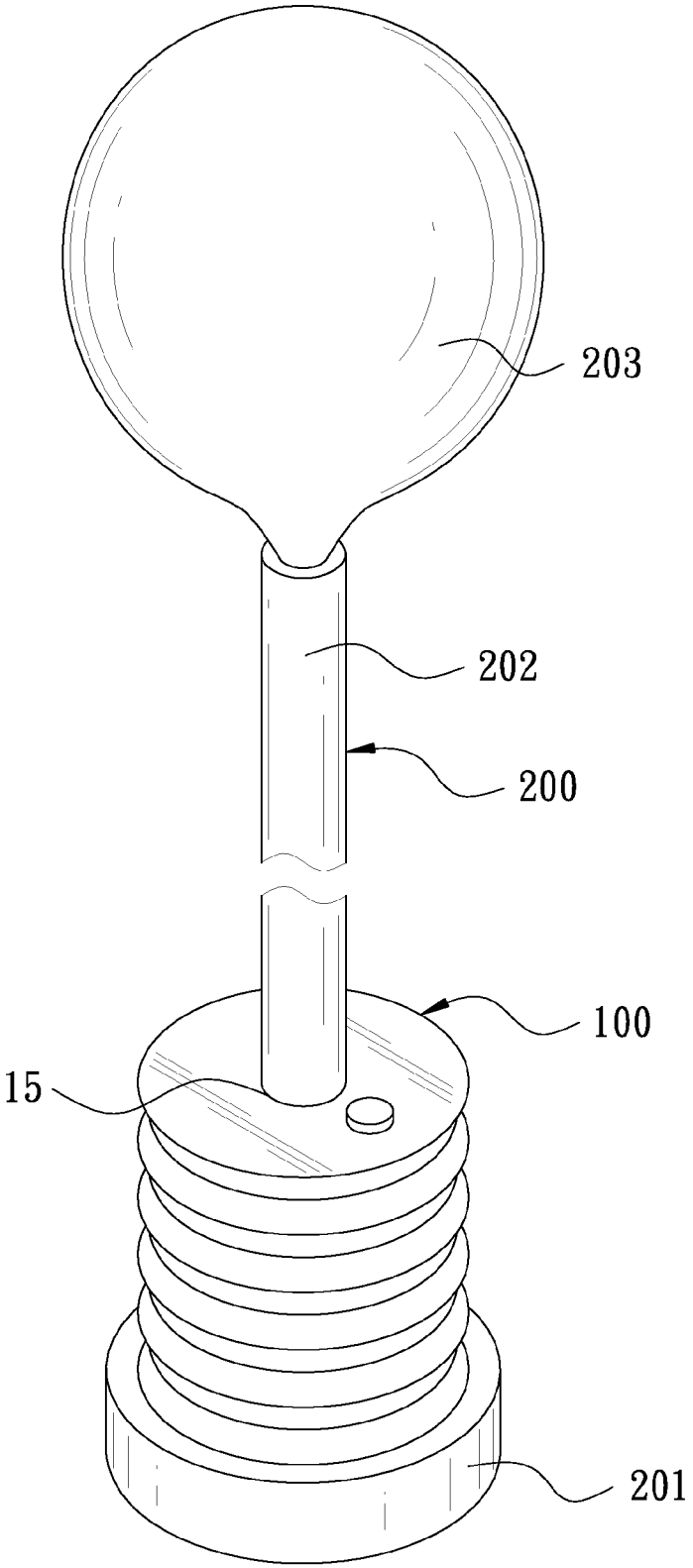
FIG. 3 is a schematic view showing a use state of the first embodiment of the present invention.
Figure 4:
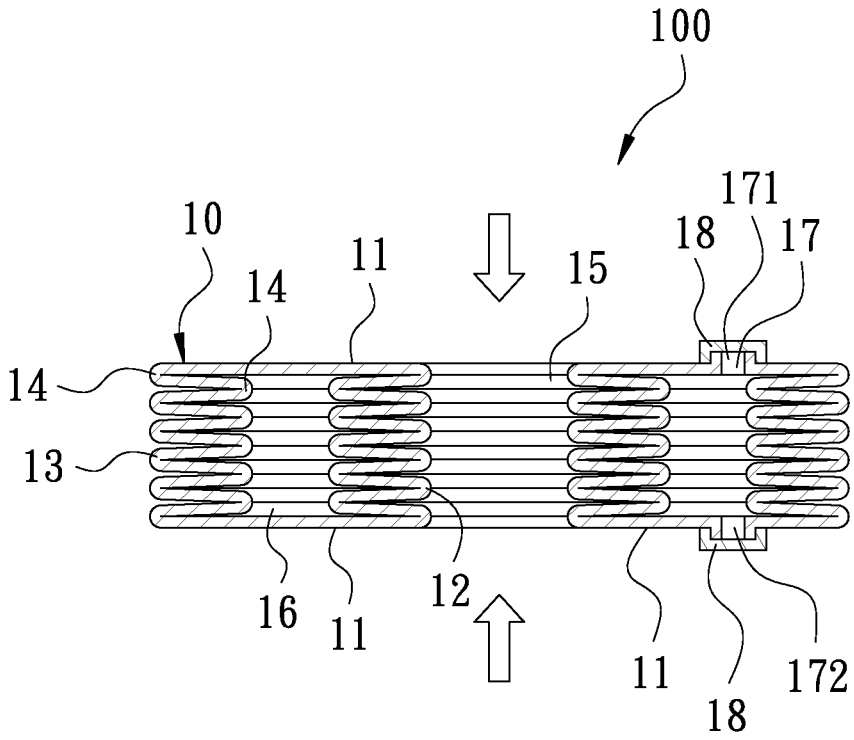
FIG. 4 is a sectional view showing an operation state of the first embodiment of the present invention.

FIG. 3 is a schematic view showing a use state of the first embodiment of the present invention. FIG. 4 is a sectional view showing an operation state of the first embodiment of the present invention. The hanging counterweight device 100 is applied to a hitting trainer 200. The hitting trainer 200 comprises a base 201, an upright rod 202 disposed on the base 201, and a hitting member 203 connected to the upright rod 202 for hitting practice. As shown in FIG. 3, when the counterweight device 100 is used, the upright rod 202 is inserted through the through hole 15 so that the counterweight bag 10 is fitted on the base 201. The counterweight bag 10 is unfolded by extending the telescopic portions 14 to increase the volume of the accommodation room 16. Finally, external liquid, such as water or the like, is poured into the accommodation room 16 through the water inlet 171 to increase the weight of the counterweight bag 10, such that the hitting trainer can be placed on the uneven ground stably. When the counterweight device 100 is not used, the water outlet 172 is opened to drain the liquid in the accommodation room 16. As shown in FIG. 4, the counterweight bag 10 is detached from the hitting trainer 200. The counterweight bag 10 is folded by compressing the telescopic portions 14 to reduce the volume of the counterweight bag 10 for storage and carrying.

Figure 5:
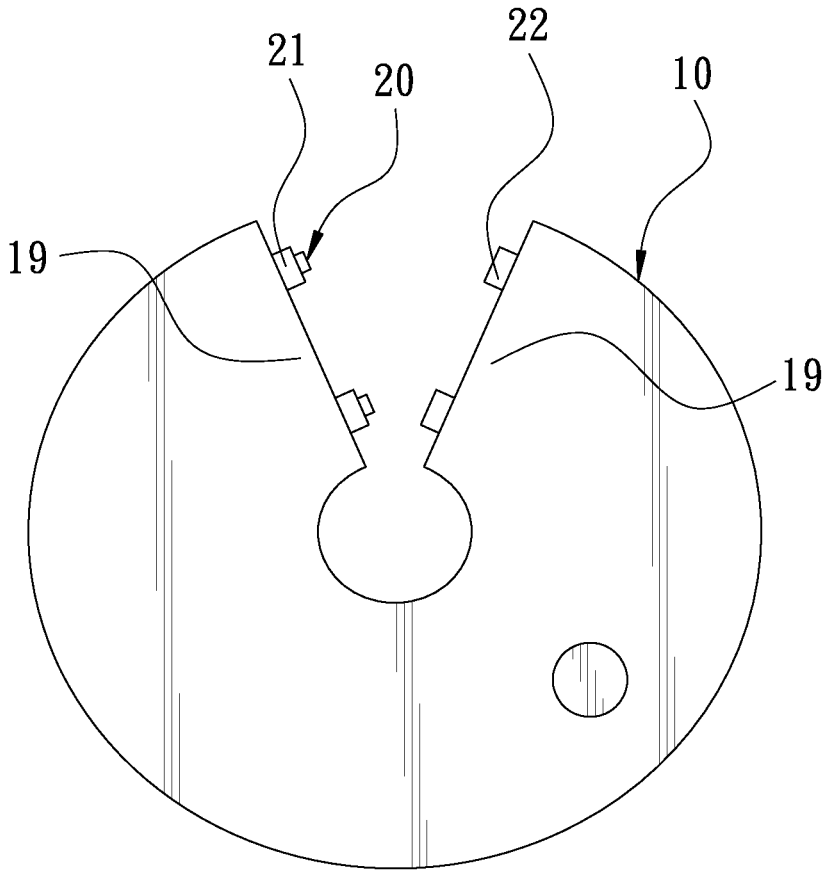
FIG. 5 is a plane view according to a second embodiment of the present invention.

FIG. 5 is a plane view according to a second embodiment of the present invention. The counterweight device 100 of the second embodiment is substantially similar to the first embodiment with the exceptions described hereinafter. The counterweight bag 10 has a C shape. The counterweight bag 10 has two ends 19 and a connecting unit 20. The connecting unit 20 has a male member 21 and a female member 22. The male member 21 and the female member 22 are respectively disposed on the two ends 19. The male member 21 and the female member 22 are connected with each other to form the annular counterweight bag 10. In this embodiment, the male member 21 is a male buckle, and the female member 22 is a female buckle. Thereby, when the counterweight bag 10 is used, the male buckle 21 and the female buckle 22 are disconnected from each other, and the counterweight bag 10 is disposed on the base 201, and then the male buckle 21 and the female buckle 22 are connected with each other for the counterweight bag 10 to limit the base 210. Compared to the first embodiment, the second embodiment is convenient for the user to mount the counterweight bag 10 to the hitting trainer 200.

Figure 6:
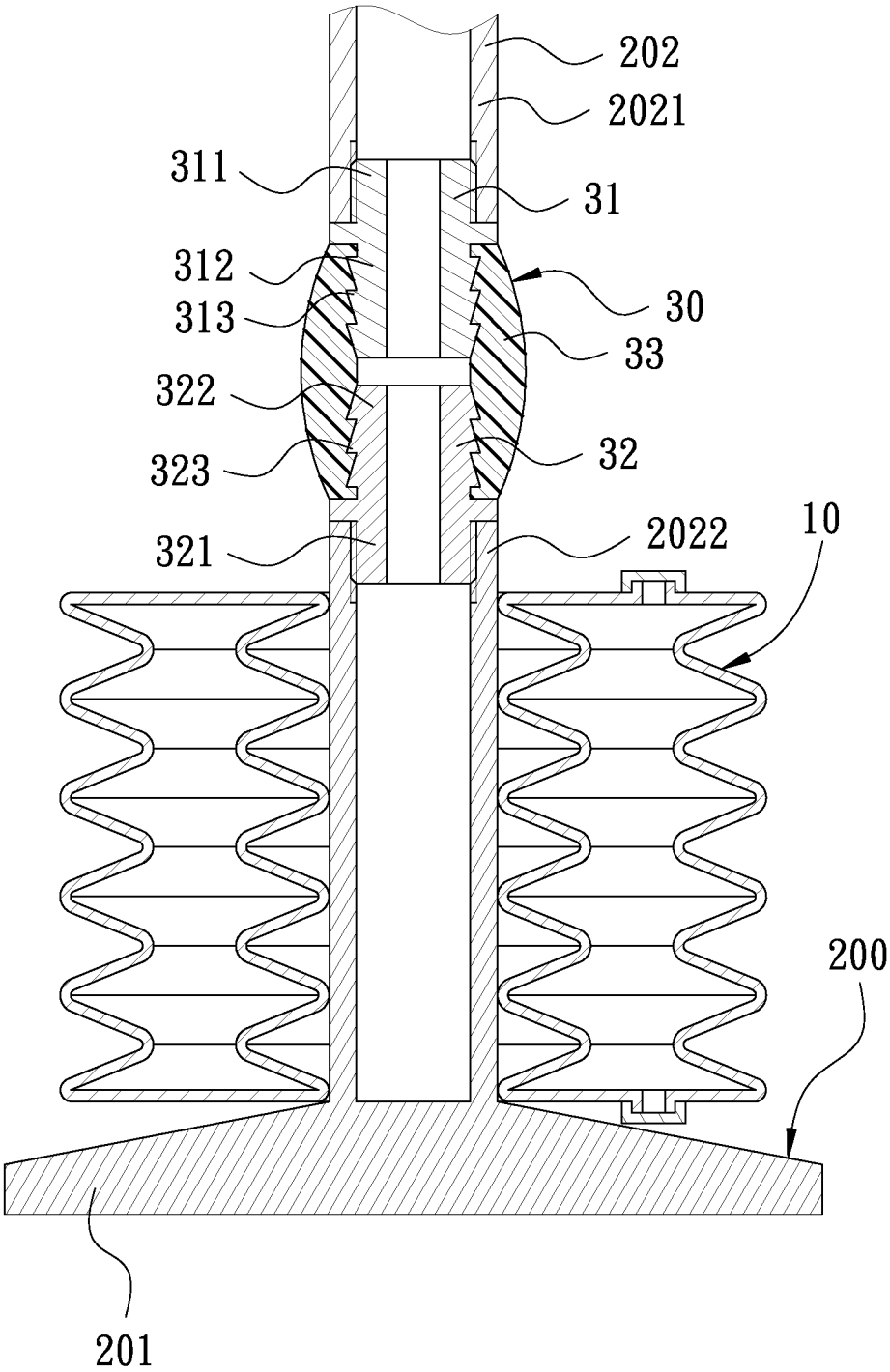
FIG. 6 is a sectional view according to a third embodiment of the present invention.

FIG. 6 is a sectional view according to a third embodiment of the present invention. The counterweight device 100 of the third embodiment is substantially similar to the first embodiment with the exceptions described hereinafter. The upright rod 202 is divided into an upper section 2021 and a lower section 2022. A buffer unit 30 is connected between the upper section 2021 and the lower section 2022. The buffer unit 30 comprises an upper seat 31 connected to the upper section 2021, a lower seat 32 connected to the lower section 2022, and a buffer member 33 connected between the upper seat 31 and the lower seat 32. The upper seat 31 has an upper threaded end 311 and an upper connecting end 312 at two ends thereof. The upper threaded end 311 is threadedly connected to the upper section 2021. The lower seat 32 has a lower threaded end 321 and a lower connecting end 322 at two ends thereof. The lower threaded end 321 is threadedly connected to the lower section 2022. The buffer member 33 wraps the outer walls of the upper connecting end 312 and the lower connecting end 322 to connect the upper connecting end 312 and the lower connecting end 322. The outer walls of the upper connecting end 312 and the lower connecting end 322 are formed with a plurality of annular barb portions 313, 323, respectively. The elastic member 33 is made of PU (Polyurethane). When the user hits the hitting member 203 to bring the upright rod 202 to have a deflection, the buffer member 33 of the buffer unit 30 will provide a counterforce so that the upright rod 202 will return quickly to provide a shock absorption effect.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A counterweight device for a hitting trainer, the counterweight device being mounted to the hitting trainer, the hitting trainer comprising a base, an upright rod disposed on the base and a hitting member connected to the upright rod for hitting practice, the counterweight device comprising:

a counterweight bag, the counterweight bag being an annular bag, the counterweight bag having a pair of side walls, an inner annular wall and an outer annular wall, the inner annular wall and the outer annular wall being connected between the pair of side walls, the inner annular wall and the outer annular wall each having a plurality of spaced telescopic portions for the counterweight bag to be extended or compressed, the inner annular wall being configured in a circle to form a through hole in the counterweight bag, an accommodation room being defined among the pair of side walls, the inner annular wall and the outer annular wall, the accommodation room communicating with at least one opening; and wherein the counterweight bag has two openings, the two openings respectively defining a water inlet and a water outlet.

2. The counterweight device for a hitting trainer as claimed in claim 1, wherein the inner annular wall and the outer annular wall are bent symmetrically to form a wavy shape, the telescopic portions being disposed at each wave crest and each wave trough.

3. The counterweight device for a hitting trainer as claimed in claim 1, wherein the opening is provided with a cover.

4. The counterweight device for a hitting trainer as claimed in claim 1, wherein the counterweight bag has a C shape, the counterweight bag having two ends and a connecting unit, the connecting unit having a male member and a female member, the male member and the female member being respectively disposed on the two ends, the male member and the female member being connected with each other to form the annular counterweight bag.

5. The counterweight device for a hitting trainer as claimed in claim 4, wherein the male member is a male buckle and the female member is a female buckle.

6. The counterweight device for a hitting trainer as claimed in claim 1, wherein the upright rod is divided into an upper section and a lower section, a buffer unit being connected between the upper section and the lower section, the buffer unit comprising an upper seat connected to the upper section, a lower seat connected to the lower section, and a buffer member connected between the upper seat and the lower seat.

7. The counterweight device for a hitting trainer as claimed in claim 6, wherein the upper seat has an upper threaded end and an upper connecting end at two ends thereof, the upper threaded end being threadedly connected to the upper section, the lower seat having a lower threaded end and a lower connecting end at two ends thereof, the lower threaded end being threadedly connected to the lower section, the buffer member wrapping outer walls of the upper connecting end and the lower connecting end to connect the upper connecting end and the lower connecting end.

8. The counterweight device for a hitting trainer as claimed in claim 7, wherein the outer walls of the upper connecting end and the lower connecting end are formed with a plurality of annular barb portions, respectively.

9. The counterweight device for a hitting trainer as claimed in claim 6, the elastic member is made of PU (Polyurethane).

* * * * *